US006213517B1

(12) United States Patent
Goluszka et al.

(10) Patent No.: US 6,213,517 B1
(45) Date of Patent: Apr. 10, 2001

(54) CLIPBOARD

(75) Inventors: Michael Goluszka, Inverness; Kurt Peterson, Mt. Prospect; Frank Guzzo, Melrose Park, all of IL (US)

(73) Assignee: Tenex Corporation, Elk Grove Village, IL (US)

( * ) Notice: Subject to any disclaimer, the term of this patent is extended or adjusted under 35 U.S.C. 154(b) by 0 days.

(21) Appl. No.: 09/654,251

(22) Filed: Sep. 1, 2000

(51) Int. Cl.[7] ..... B42D 17/00
(52) U.S. Cl. ..... 281/45; 281/42
(58) Field of Search ..... 281/42, 45, 15.1, 281/21.1, 28, 51; 24/67.7, 67.11; 248/444.1, 451, 452; D19/88

(56) References Cited

U.S. PATENT DOCUMENTS

| | | | | |
|---|---|---|---|---|
| 4,501,438 | * | 2/1985 | McKee | 281/45 |
| 5,226,215 | * | 7/1993 | Evenson | 281/45 X |
| 5,725,250 | * | 3/1998 | Balderrama | 281/45 |
| 5,887,902 | * | 3/1999 | Irwin et al. | 281/45 |

* cited by examiner

*Primary Examiner*—Willmon Fridie, Jr.
(74) *Attorney, Agent, or Firm*—Cook, Alex, McFarron, Manzo, Cummings & Mehler, Ltd.

(57) ABSTRACT

A clipboard of integral one piece design having a clip head which is joined to the sheet of the clipboard by a living hinge and having resilient elements formed integrally with the sheet and clip head for urging the clip head and sheet toward each other.

11 Claims, 5 Drawing Sheets

CLIPBOARD

BACKGROUND AND SUMMARY OF INVENTION

The present invention relates to a clipboard and, more particularly, to a clipboard in which all of the components are formed integrally and in one piece relationship with each other.

In the clipboard of the present invention, the integral one piece relationship of the components simplifies the manufacture and assembly of the clipboard, is more economic, and is less prone to breaking and loss of parts than the typical spring loaded clipboard assemblies that were previously common.

In one principal aspect of the present invention, a clipboard comprises a generally flat planar sheet of material; a clip head adjacent an end of the sheet and having a surface for contacting an object which is to be mounted to the clipboard; and a hinge mounting the clip head integrally with the sheet at the end of the sheet, the hinge permitting movement of the clip head into overlying relationship with the flat planar sheet. A receptacle underlies the overlying clip head, and the receptacle is flexibly fixed to either the sheet or to the clip head to permit the receptacle to move and flex relative thereto. A stud extends from the other of the sheet or overlying clip head and into locked relationship with the receptacle to form a spring arrangement which urges the surface of the clip head toward the flat planar sheet.

In another principal aspect of the invention, the receptacle is fixed to the sheet, and the stud is on and extends from the overlying clip head.

In still another principal aspect of the present invention, the hinge is a living hinge.

In still another principal aspect of the present invention, a resilient finger is on the sheet and extends upwardly from the sheet toward the surface on the clip head.

In still another principal aspect of the present invention, the resilient finger is formed integrally with the sheet.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
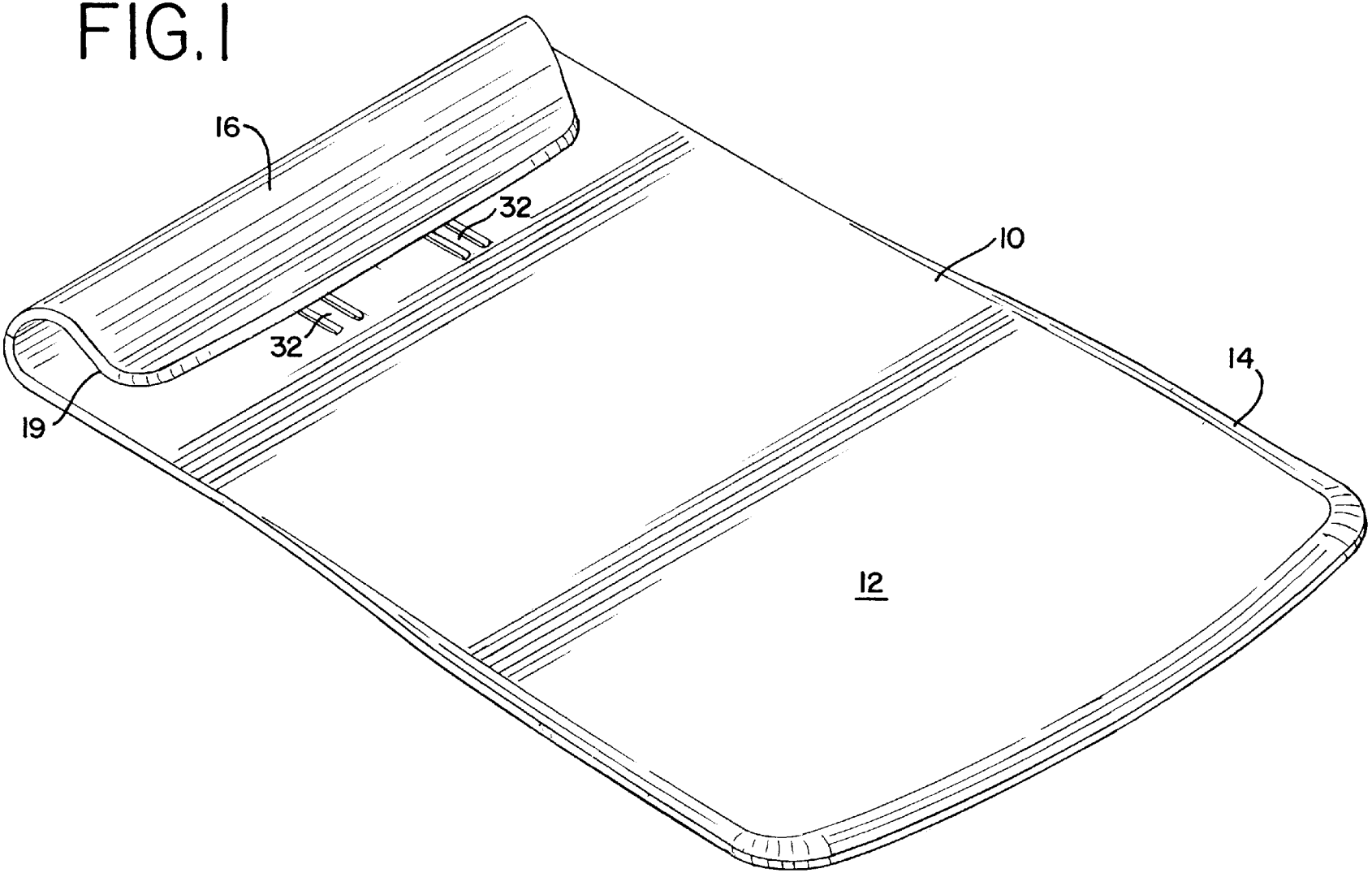
FIG. 1 is an overall perspective view of a preferred embodiment of clipboard of the present invention.
Figure 2:
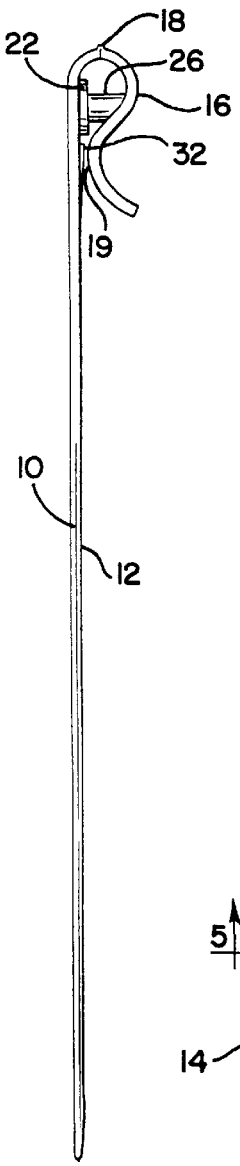
FIG. 2 is a side elevation view of the clipboard shown in FIG. 1.
Figure 3:
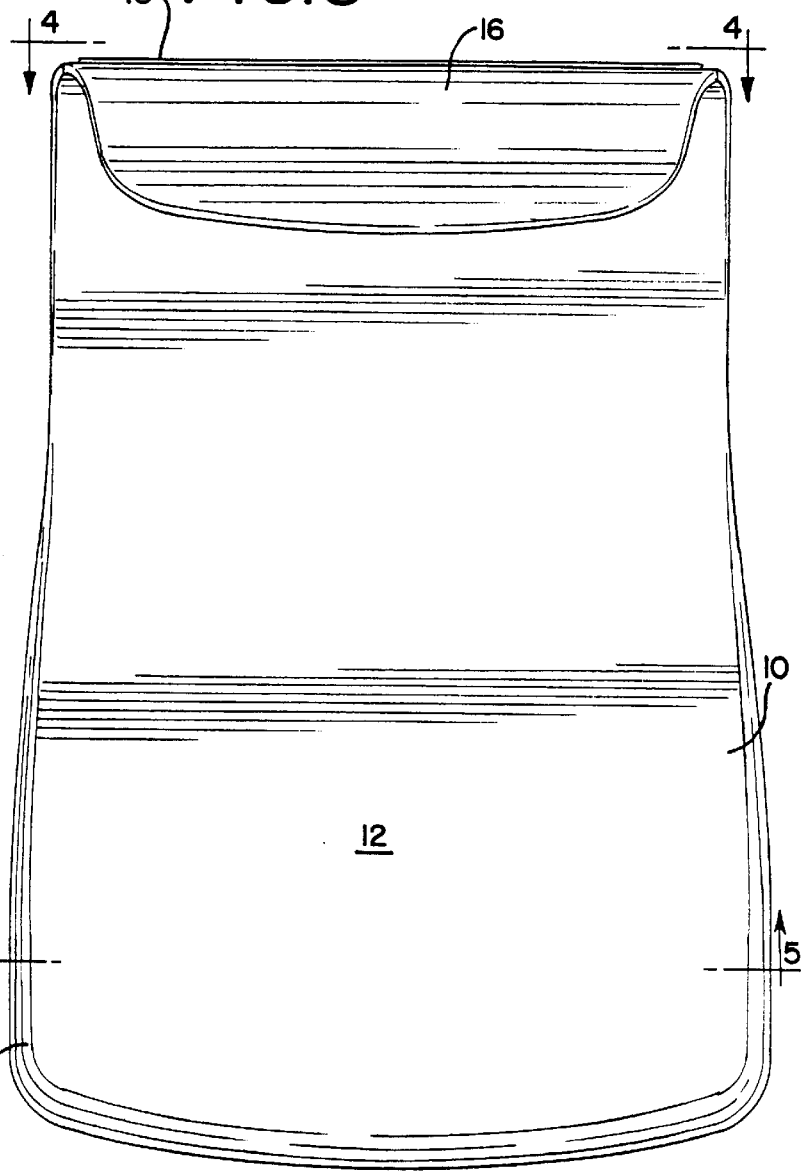
FIG. 3 is a top plan view of the clipboard shown in FIG. 1.
Figure 4:
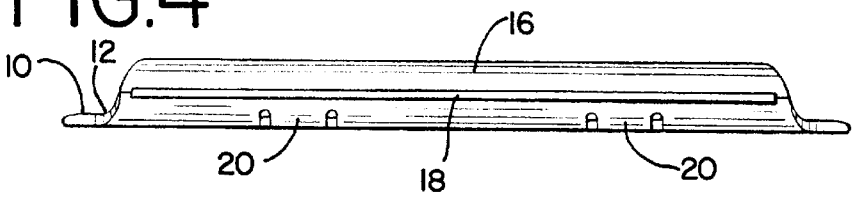
FIG. 4 is a top end elevation view of the clipboard as viewed substantially along line 4—4 of FIG. 3.
Figure 5:
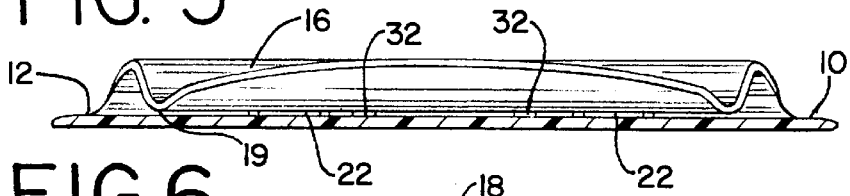
FIG. 5 is a cross-sectioned elevation view of the clipboard as viewed substantially along line 5—5 of FIG. 3.

As shown in the drawings, the preferred embodiment of clipboard of the present invention includes a generally flat, rigid planar sheet of material 10 having an upper face 12 upon which sheets of paper P or other objects typically utilized with a clipboard may be supported. The edges 14 of the sheet 10 may be curved or rounded either or both for aesthetic reasons and/or to reduce sharpness.

A clip head 16 is fixed at the top end of the sheet 12 with a hinge 18. The clip head 16 is preferably integrally molded with the sheet 12 and the hinge 18 is preferably of the same molded material so that it is formed as a "living hinge" as is known in the art. Such living hinges are formed during the molding process, and when the object is removed from the mold, the hinge is immediately flexed to activate it. With the hinge 18, it will be seen that the clip head 16 is capable of pivotal movement along the hinge 18 between a position in which it is opened out as seen in FIGS. 7 and 8, and an operational position in which it is in overlying relationship to the upper face 12 of the sheet 10 to perform its clipping function by clamping the sheets of paper P beneath the contact surface 19 of clip head where it most closely approaches the upper face 12.

Figure 6:
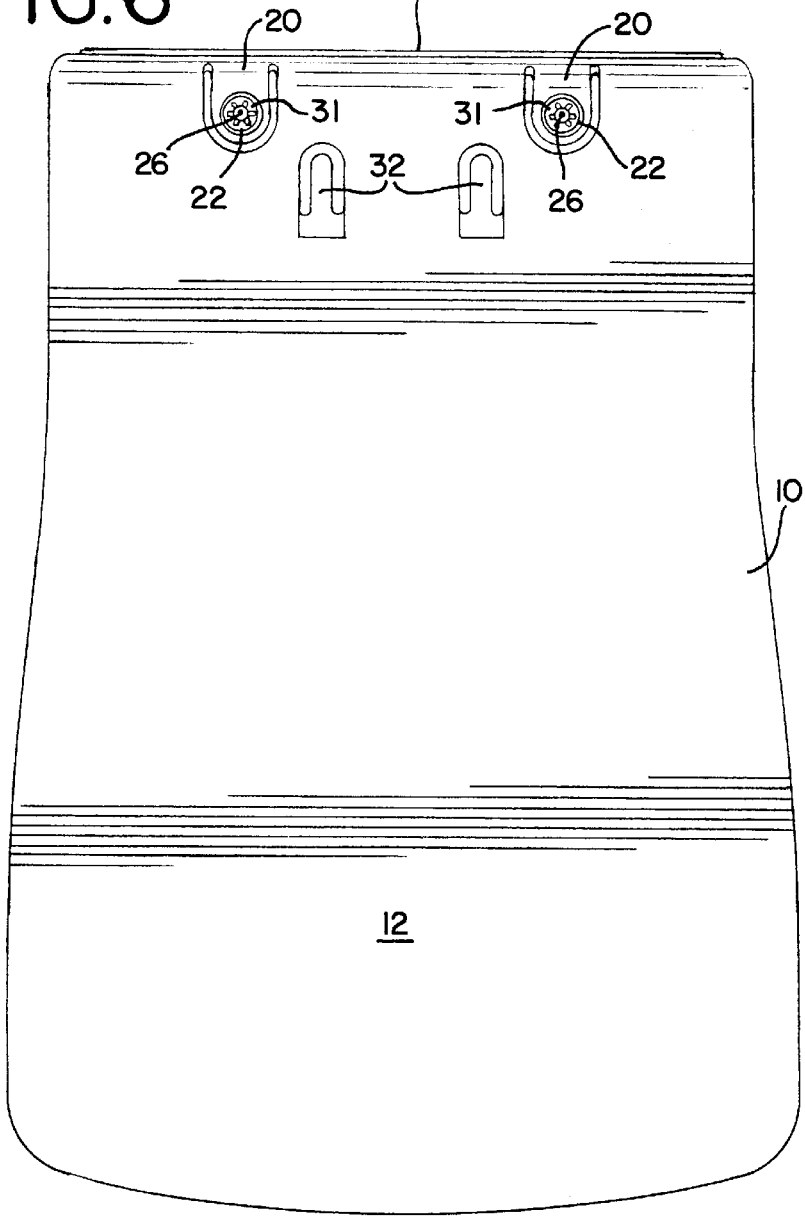
FIG. 6 is a bottom plan view of the clipboard shown in FIG. 1.
Figure 7:
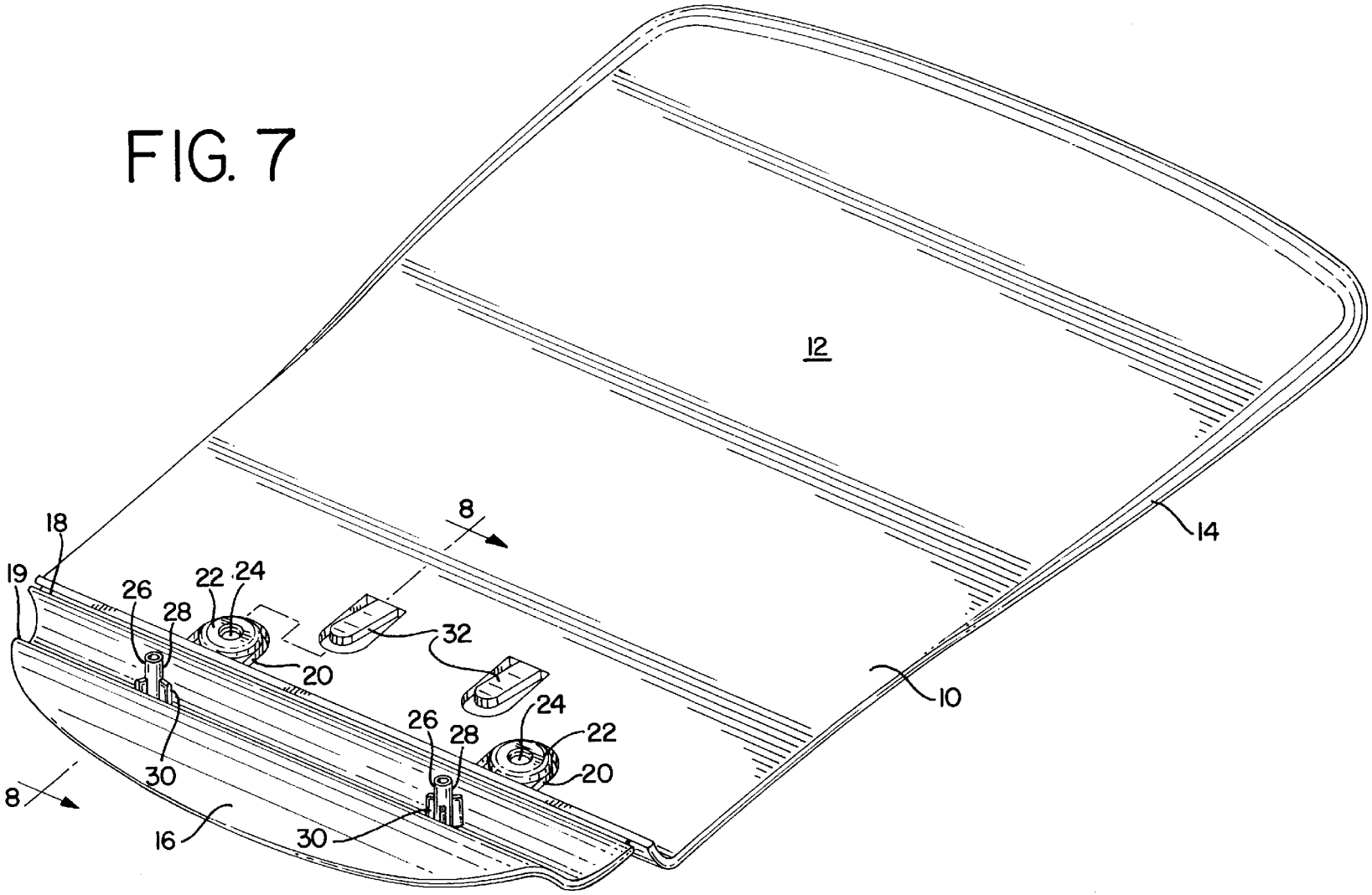
FIG. 7 is a perspective bottom view of the clipboard of FIG. 1 with the clip head opened out.

A pair of tabs 20, as best seen in FIGS. 6 and 7, are also formed on the sheet 12, preferably by being molded with the sheet. The tabs 20 include a receptacle 22 with an opening 24 therethrough. The tabs 20 are resilient and flexible to permit the receptacle to move relative to the sheet 10 and its upper face as best seen in FIG. 9.

A winged stud 26 is also preferably molded integrally to the underside of the clip head 16. The winged stud 26 comprises an elongate pin 28 with a plurality of spaced vertical wings 30 which extend partially over the length of the pin, as best seen in FIGS. 7–9.

Figure 8:
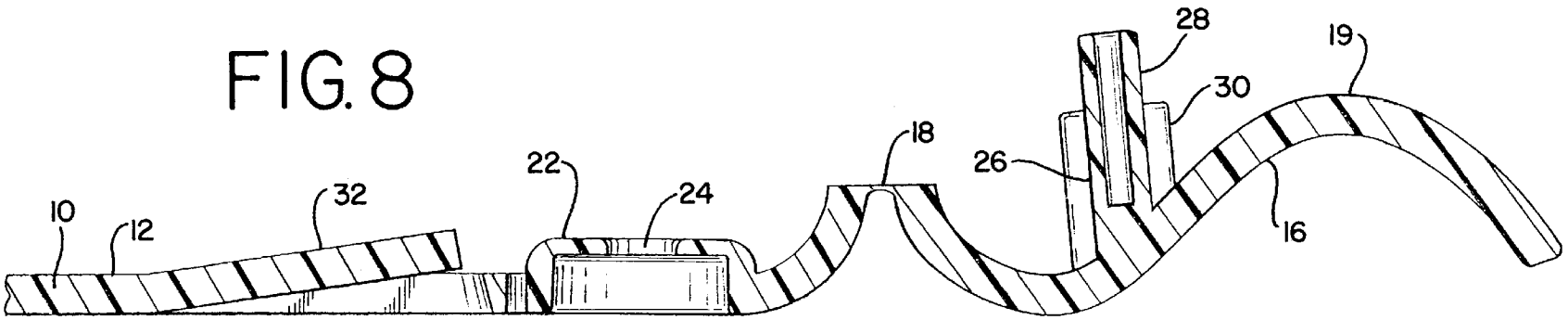
FIG. 8 is an enlarged broken, cross-sectioned side elevation of the clipboard as viewed substantially along line 8—8 of FIG. 7 with the clip head opened out.
Figure 9:
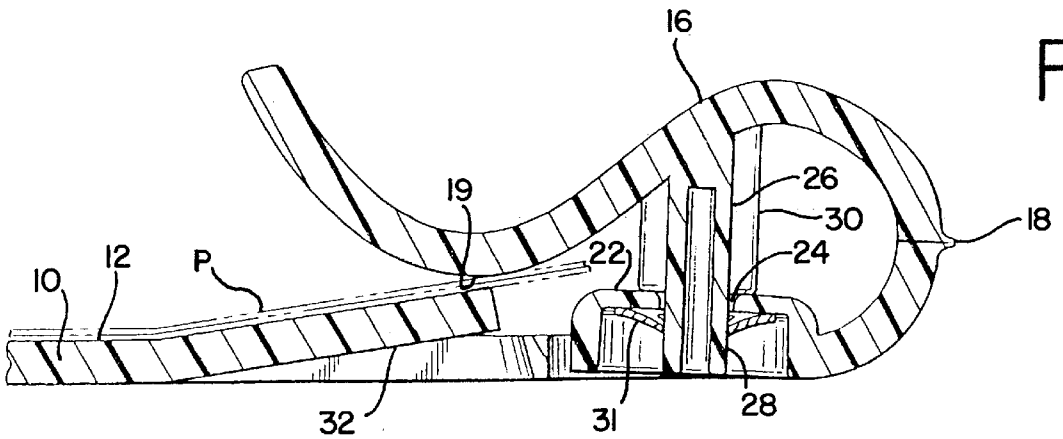
FIG. 9 is an enlarged broken, cross-sectional side elevation view of the section shown in FIG. 8, but with the clip head closed and in its operational position.

When the clip head 16 is moved from the opened out position, as shown in FIG. 8, into overlying relationship with the face 12 of sheet 10, as shown in FIG. 9, the pin 28 of the winged stud 26 will extend through the opening 24 of receptacle 22, and the wings 30 will act as spacers between the clip head and the top of the receptacle. The pin 28 is then held in the receptacle 22 by a suitable lock washer 31, as best seen in FIG. 9.

A pair of resilient, flexible spring like fingers 32 are also preferably integrally molded with the sheet 10 and extend upwardly at a slight angle to its face 12 as best seen in FIGS. 2, 7–9. The fingers 32 assist in gripping the paper P or other objects which are to be utilized with the clipboard by exerting an upward force on the objects in the direction of the contact surface 19 of the clip head 16, as best seen in FIG. 9.

Although it is believed that one skilled in the art would readily understand how to assemble the clipboard of the invention from the foregoing description, a brief description of assembly follows.

The clipboard and all of its components are preferably formed of the same material and in integral one piece relationship to each other by injection molding or other suitable molding procedure. The material may be any suitable polymer, but polypropylene is preferred. When the clipboard is removed from the mold, the living hinge 18 is preferably flexed immediately to activate it. The clip head 16 is then rotated from its open position as seen in FIGS. 7 and 8 to the position in which it overlies the clipboard upper face 12, as seen in FIG. 9.

When the clip head 16 is rotated to this position, the pin 28 of the winged stud will enter the opening 24 of the receptacle 22. Once the pin is fully inserted into the opening 24 and spaced by the wings 30, the lock washer 31 is positioned over the end of the pin 28 to hold the pin in the receptacle. It will be seen in FIG. 9 that when the winged stud 26 and receptacle 22 have been locked together, the receptacle 22 will be flexed upwardly slightly from the plane of the upper face 12. Because of the resilient, flexible nature of the tabs 20, this flexing will exert a spring force in the downward direction on the clip head 16 toward the surface 12 and against the upwardly extending resilient fingers 32. This will provide a good spring frictional contact and engagement between the contact surface 19 of the clip head 16 and the spring fingers 32 to hold the paper P or other objects which are to be utilized with the clip board.

It will be understood that the preferred embodiment of the present invention which has been described is merely illustrative of the principles of the invention. Numerous modifications may be made by those skilled in the art without departing from the true spirit and scope of the invention.

We claim:

1. A clipboard comprising:

a generally flat planar sheet of material;

a clip head adjacent an end of said sheet, said clip head having a surface for contacting an object which is to be mounted to the clipboard;

a hinge mounting said clip head integrally with said sheet at said end of said sheet, said hinge permitting movement of said clip head into overlying relationship with said flat planar sheet;

a receptacle underlying said overlying clip head, said receptacle being flexibly fixed to either said sheet or to said clip head to permit said receptacle to move and flex relative thereto; and a stud extending from the other of said sheet or overlying clip head and into locked relationship with said receptacle to form a spring arrangement which urges said surface of said clip head toward said flat planar sheet.

2. The clipboard of claim 1, wherein said receptacle is fixed to said sheet, and said stud is on and extends from said overlying clip head.

3. The clipboard of claim 1, wherein said hinge is a living hinge.

4. The clipboard of claim 1, including a resilient finger on said sheet and extending upwardly from said sheet toward said surface on said clip head.

5. The clipboard of claim 4, wherein said resilient finger is formed integrally with said sheet.

6. The clipboard of claim 5, wherein said receptacle is formed integrally with said sheet, and said stud is formed integrally with said clip head.

7. The clipboard of claim 4, wherein said sheet, clip head, hinge, receptacle, stud and finger are all formed of the same material.

8. The clipboard of claim 4, wherein said sheet, clip head, hinge, receptacle, stud and finger are all injection molded of the same material.

9. The clipboard of claim 1, wherein said sheet, clip head, hinge, receptacle and stud are all formed of the same material.

10. The clipboard of claim 1, wherein said sheet, clip head, hinge, receptacle and stud are all injection molded of the same material.

11. The clipboard of claim 1, wherein said receptacle is formed integrally with said sheet, and said stud is formed integrally with said clip head.

* * * * *